US006511633B1

(12) United States Patent
Yang

(10) Patent No.: US 6,511,633 B1
(45) Date of Patent: Jan. 28, 2003

(54) FREE-MACHINABLE EUTECTIC AL-SI ALLOY

(75) Inventor: Young Sek Yang, Kyunggi-do (KR)

(73) Assignee: Foosung Precision Ind., Co., Ltd., Kyunggi-do (KR)

( * ) Notice: Subject to any disclaimer, the term of this patent is extended or adjusted under 35 U.S.C. 154(b) by 0 days.

(21) Appl. No.: 10/158,551

(22) Filed: May 31, 2002

(30) Foreign Application Priority Data

Mar. 27, 2002 (KR) ..... 02-16720

(51) Int. Cl.[7] ..... C22C 21/04

(52) U.S. Cl. ..... 420/537; 420/538; 420/554

(58) Field of Search ..... 420/537, 538, 420/548, 554, 536, 549, 550, 551

(56) References Cited

U.S. PATENT DOCUMENTS 5,122,207 A * 6/1992 Alabi ..... 148/415

OTHER PUBLICATIONS

"Internation Alloy Designations and Chemical Composition limits for Wrought Aluminum and Wrought Aluminum Alloys", The Aluminum Association, 1997.*

* cited by examiner

*Primary Examiner*—George Wyszomierski
*Assistant Examiner*—Janelle Combs-Morillo
(74) *Attorney, Agent, or Firm*—Harrison & Egbert

(57) ABSTRACT

A free-machinable eutectic Al—Si alloy including 3.0–5.0 wt % Cu, 10.0–13.0 wt % Si, 0.2–0.5 wt % Fe, 2.5–5.0 wt % Bi, 0.1–0.3 wt % Sb, up to 0.1 wt % Mg, up to 0.1 wt % Ni and up to 0.5 wt % total sum of other elements, with the balance of the alloy being Al. The eutectic Al—Si alloy is advantageous in light of excellent machinability, easy cutting operation, extended lifetime of cutting tools and improved smoothness of cutting faces. In addition, the alloy has an excellent elongation ratio and abrasion resistance and good formability, while maintaining mechanical properties such as impact strength, tensile strength, yield strength and hardness which can be applied to compressor piston for air conditioner in motorcars, and thus can be applied to abrasion resistance-requiring applications, for example, piston of compressors for automotive air conditioners, without any surface treatment including anodizing or Sn plating.

1 Claim, 2 Drawing Sheets

FREE-MACHINABLE EUTECTIC AL-SI ALLOY

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to a eutectic Al—Si alloy having excellent free machinability and abrasion resistance. In the present invention, the free machinability means that machinability is excellent.

The inventive eutectic Al—Si alloy can be applied to parts requiring formability, workability and abrasion resistance, such as scrolls or pistons of compressors for air conditioners in automobiles or appliances.

BACKGROUND OF THE INVENTION

Lubricants should be continuously fed to friction face of scrolls or pistons. Otherwise, seizure between friction metals occurs. So, metal materials having excellent abrasion resistance as well as formability and workability are suitable for use in such parts.

On the other hand, in order to manufacture lightweight automobiles or appliances, metals having low specific gravity are used. Also, even though metals are excellent in abrasion resistance and have low specific gravity, if they have poor workability including machinability, preparation cost becomes high. Metals, such as cast iron or bronze, have the advantage of excellent machinability but suffer from the disadvantage of high specific gravity. Therefore, in recent years, Al-based alloys are widely used. Excellent ductility of these metals results in improved formability.

Typically, there is a representative eutectic Al—Si alloy having excellent abrasion resistance, lightweight property, and relatively superior formability and workability, as shown in the following

TABLE 1

Composition of Conventional Eutectic Al-Si Alloy

| Composition Component | Composition Ratio (wt %) |
|---|---|
| Si | 11.0–1.35 |
| Cu | 0.5–1.3 |
| Fe | 1.0 or less |
| Mg | 0.8–1.3 |
| Cr | 0.10 or less |
| Ni | 0.5–1.3 |
| Al | Balance |

Such alloy is called A4032 alloy in the related fields.

In alloys comprising two or more metals, the metals which are able to produce a congruent compound are used stoichiometrically, in which the congruent compound refers to that one metal of solid phase which is melted in the other metal of liquid phase at melted state or solid solution state. The alloy forming the congruent compound appears to be in equilibrium state.

The alloy which consists of compositions forming the congruent compound is called a eutectic alloy, in which the eutectic alloy exists at the eutectic point in equilibrium diagrams of alloys. Alloys which are positioned at the left side of eutectic point in the equilibrium diagram are referred to as hypo-eutectic alloys, and alloys located at the right side of eutectic point in the diagram are called hyper-eutectic alloys.

As for Al—Si alloy, alloys having 12.5 wt % of Si correspond to congruent compounds. Commonly, if Si content ranges from 11 to 13 wt % , such alloy is called a eutectic alloy. On the other hand, hypo-eutectic alloys have Si content less than said range and hyper-eutectic alloys have Si content higher than said range.

In the case of applying to pistons in compressors for automobile air conditioners, conventional A4032 eutectic alloys representatively used in this field are subject to surface-treatment, such as anodizing or Sn plating, to improve abrasion resistance. Such conventional alloy is disadvantageous in that, unless lubricants are smoothly fed onto friction faces, seizure between the metals occurs. As well, cutting workability becomes poor and abrasion ratio of cutting tools is very high, thus increasing preparation cost.

There is thus a widely recognized need for materials having superior machinability and abrasion resistance to conventional A4032 alloy.

BRIEF SUMMARY OF THE INVENTION

It is an object of the present invention to provide a eutectic Al—Si alloy, which is excellent in free-machinability and abrasion resistance and maintains high strength through heat treatment.

The intensive and thorough research on a eutectic Al—Si alloy, carried outby the present inventors aiming to avoid the problems encountered in the prior arts, resulted in the finding that, on preparation of a eutectic Al—Si alloy, Sb, not reactive with Bi, is added, along with Bi, under conditions that Sr, strongly reactive with Bi, is not used, and amounts of Mg, Mn and Ni to be added are minimized, yielding Al—Si—Cu—Bi alloy, whereby eutectic Al—Si alloys which have superior free-machinability, abrasion resistance and ductility to conventional eutectic Al—Si alloys, and maintain high strength though heat treatment, can be obtained.

As for conventional eutectic Al—Si alloys, there was no alloy containing Sb as a component.

DETAILED DESCRIPTION OF THE INVENTION

Figure 1:
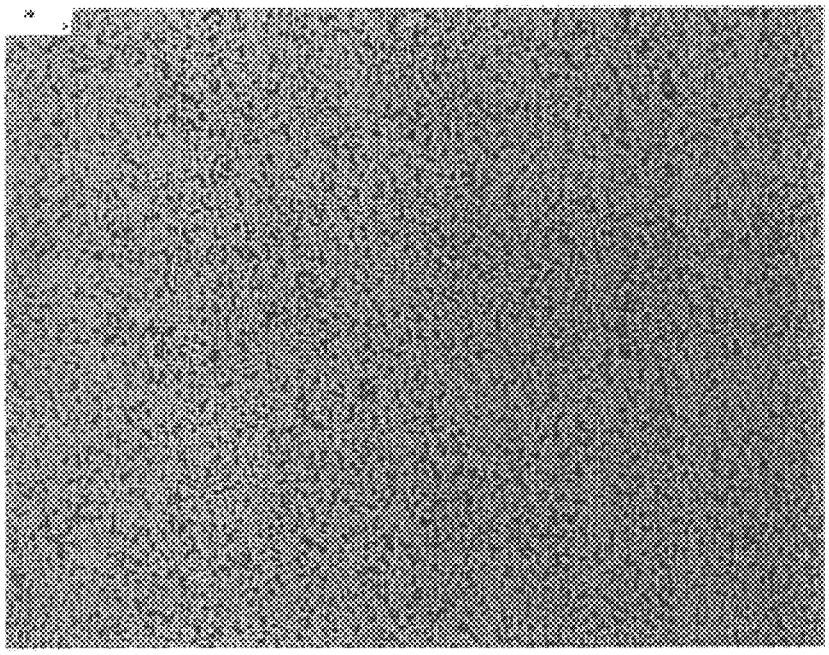
FIG. 1 is a photograph showing eutectic Al—Si alloy structure obtained from the example, taken by an optical microscope.

The present invention is directed to a eutectic Al—Si alloy, which is excellent in free-machinability, abrasion resistance and ductility due to an addition of suitable amounts of Sb, Cu, Bi and Fe components, and which can maintain high strength through heat treatment.

Commonly, it is known that the Bi-added Al—Si alloy has improved prevention of intermetallic seizure.

The Bi-phase that is uniformly dispersed in the base structure allows chips obtained from the cutting process to be fine and to be discharged easily. In addition, the Bi-phase oozes out the cutting face by the heat generated during the cutting process (this is called "bleeding"). Such phase contributes to lubrication of the cutting face and smoothing the machined face, thus improving the smoothness of the face. So, on preparation of the Al—Si alloy performing the cutting process, addition of the Bi results in reduced seizure between the metals.

Meanwhile, the Si-phase in the Al—Si alloy should undergo modification. The modification means that the original eutectic Si-phase of coarse acicular form is uniformly dispersed to the form of fine fibers in the base structure.

However, upon formation of the Bi-containing Al—Si alloy, Bi, a highly reactive element, reacts with not only Sr, Na and Ca, which contribute to the modification of Si-phase, but also with Ni and Mg, for increasing the strength of the alloy, so that the functions of these elements are decreased and also mechanical properties of the alloy is lowered, attributable to reaction impurities. Therefore, Al—Si alloys which contain metal elements reacting with Bi as composition components should be added with excessive amounts of Bi, considering the Bi amount lost to reaction with other elements.

The alloy has the desired physical properties when the metals contained in the composition are present as intermetallic compounds through metallic bonding. But the Bi-phase is not formed as an intermetallic compound with Al, because it is independently distributed. So, the Bi-phase is not uniformly distributed in the Al—Si alloy structure and has a tendency to segregate and form a coarse phase. Further, the elements responsible for modification of Si-phase are decreased in their functions and thus the Si-phase becomes coarse, lowering the ductility of Al—Si alloy. In particular, since the amount of Si which can be added is limited with decreasing of modification of Si-phase, it is difficult to increase the abrasion resistance of the alloy. Here, coarse phase means that Si particles are large and rough and nonuniformly distributed.

As for formation of the inventive Al—Si alloy, when suitable amounts of Cu, Bi and Fe are added, together with Sb, the eutectic Al—Si alloy can be obtained, which is improved in machinability, abrasion resistance and ductility and is increased in its strength through heat treatment.

Sb, a Group 5B element in the periodic table, does not react with its analogous element, Bi.

Sb is responsible for modification of the Si-phase, while not reacting with highly reactive Bi.

The present invention is characterized in that, under the conditions of not using Sr, which reacts strongly with Sb or Bi, and of containing minimized amounts of Mg and Ni, addition of Sb to the eutectic Al—Si alloy leads to modification of Si-phase as well as reduced segregation and coarseness of Bi-phase. Thereby, functions of Bi can be carried out to the maximum extent.

Accordingly, the eutectic Al—Si alloy of the present invention having various functions of Bi is advantageous in terms of excellent free machinability and abrasion resistance, compared with conventional A4032 alloy. Further, the Si-phase that undergoes modification by Sb reduces a quantity of the cutting tools abraded during the cutting process. Furthermore, the Bi-phase, uniformly distributed in the base structure, allows the machined pieces obtained during the cutting process to be finely formed and to be easily discharged. In addition, Bi having a low melting point oozes out from the cutting face, attributable to heat created during the cutting process, so that lubrication in the cutting process is smoothly performed, thereby considerably increasing the smoothness of the cutting face.

In the inventive alloy, Cu in the form of $CuAl_2$ is responsible for maintaining high tensile strength of the alloy through heat treatment. Fe plays a role in decreasing $2^{nd}$ dendrite arm spacing, thus increasing the ductility of the alloy.

The alloys of the present invention can be used as piston materials of compressors for air conditioners in automobiles, without surface treatment such as anodizing or Sn plating required with conventional A4032 alloy.

Particularly, Sb allows Bi-phase to uniformly distribute in Al base structure, with no reaction with Bi. Therefore, since Bi having relatively high specific gravity (9.8 g/cm$^3$) and low melting point (271° C.) is uniformly distributed in Al base structure having relatively low specific gravity (2.7 g/cm$^3$) and high melting point (660° C.), seizure by heterogeneous distribution and segregation of Bi phase occurring in the base structure is reduced and thus degradation of mechanical properties of the alloy can be prevented, thereby improving low ductility which is a drawback of conventional hyper-eutectic Al—Si alloys.

Also, upon friction between the metals, Bi of low melting point is responsible for aiding lubrication of friction faces and preventing intermetallic seizure by friction heat, so increasing abrasion resistance.

A better understanding of the present invention may be obtained in light of the following example which is set forth to illustrate, but is not to be construed to limit the present invention.

EXAMPLE 44.5 kg Cu, 118 kg Si, 3.5 kg Fe, 32 kg Bi and 2.2 kg Sb were weighed and introduced into a melting furnace. These metals were high purity metals suitable for use in preparation of alloys. The metal elements were melted at 700° C. for 3–4 hours, giving billets of 130 mm diameter by continuous casting, and yielding test pieces extruded to 28 mm diameter. Such test pieces were analyzed with a spectrometer (OBLF, QSN750). As the analyzed results, the alloy obtained from the present example is composed of composition components described in the following Table 2.

Compositions of the Al—Si alloy of the present example, and conventional A4032 alloy are shown in Table 2, below.

TABLE 2

| | Alloy Composition | | | | | | | | | |
|---|---|---|---|---|---|---|---|---|---|---|
| | unit: wt % | | | | | | | | | |
| Composition | Cu | Mg | Si | Fe | Bi | Ti | Sb | Ni | Al | Total |
| Alloy of Ex. | 4.45 | — | 11.80 | 0.35 | 3.20 | — | 0.22 | — | 79.98 | 100 |
| A4032 | 1.3 | 1.2 | 11.40 | — | — | 0.018 | — | 1.2 | 84.88 | 100 |

The present alloy obtained from the example and conventional A4032 alloy were subject to $T_6$ heat-treatment, after which their mechanical properties were tested, and are given in Table 3, below.

TABLE 3

Mechanical Properties of Alloy

| Mechanical properties | Heat Treatment Condition | UTS (MPa) | YS (MPa) | Elongation Ratio (%) | Hardness (HB) |
|---|---|---|---|---|---|
| Alloy of Ex. | $T_6$ | 372 | 293 | 16 | 100 |
| A4032 alloy | $T_6$ | 380 | 310 | 9 | 140 |

UTS: Ultimate Tensile Strength
YS: Yield Strength
MPa: Mega Pascal

Next, pistons for air conditioners in automobiles, each of which was prepared by use of Al—Si alloy of the example and A4032 alloy, were tested for their rupture strength with a universal testing machine (TIRA. TT. 27100). The results are shown in the following Table 4.

TABLE 4

Rupture Strength Comparison

| | Heat treatment Condition | Maximum Load (N) |
|---|---|---|
| Alloy of Ex. 1 | $T_6$ | 62.162 |
| A4032 | $T_6$ | 61.946 |

N: Newton

<Seizure Test>

Each of the pistons prepared by the alloy of the example (no surface treatment) and by conventional A4032 alloy (Sn plating surface treatment) was mounted to compressors for air conditioners in automobiles, after which they were tested for seizure as follows.

Experimental Condition

Oil in the compressor was completely removed, and then the compressor was rotated at 1500 rpm while feeding only R134a coolant. During rotation, the time of seizure of the piston was determined.

As the results, in the piston which was prepared from A4032 alloy and surface-treated with Sn plating, seizure occurred at 9 min. However, seizure did not occur in the inventive alloy-prepared piston (no surface treatment), even after 200 hrs.

FIG. 1 is an optical microscopic photograph of the eutectic Al—Si alloy structure of the example.

The black-point parts in the photograph show eutectic Si-phase in the eutectic Al—Si alloy, in which it can be seen that the eutectic Si phase is finely and uniformly distributed. This means that modification of Si phase is almost completely performed.

Figure 2:
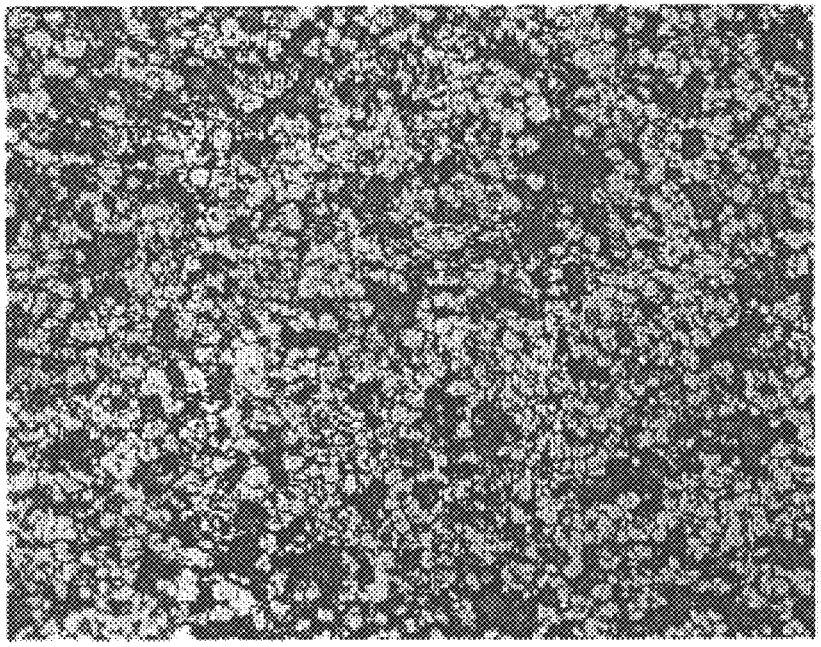
FIG. 2 is a photograph showing eutectic Al—Si alloy structure after only Bi phase is etching-removed from a eutectic Al—Si alloy obtained from the example, taken by an optical microscope.

Referring to FIG. 2, there is shown an optical microscopic photograph after Bi phase in Al—Si alloy of the example was etch-removed.

It appears that Bi phase uniformly distributed in the base structure is removed by etching, as can be seen in FIG. 2.

Figure 3:
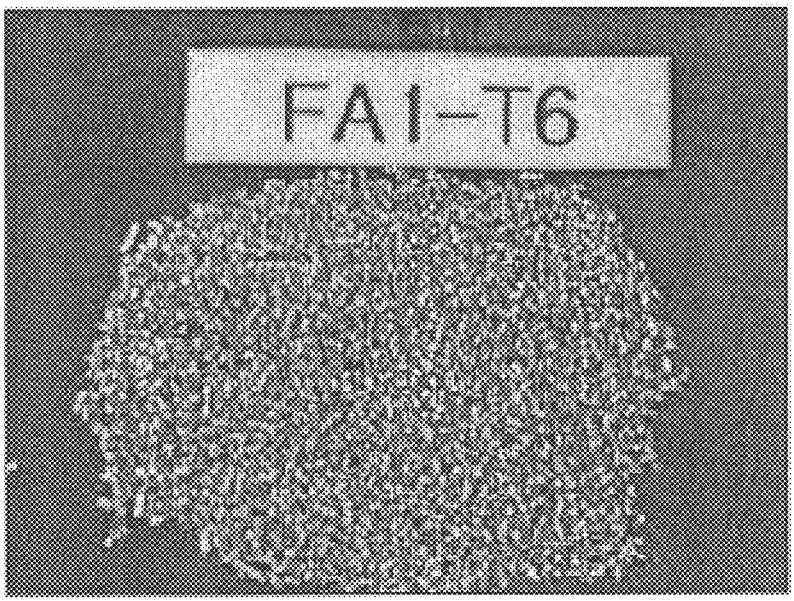
FIG. 3 is a photograph showing the state of machined pieces of the alloy in the example.

FIG. 3 illustrates the state of the machined pieces of the alloy obtained from the example.

The machined pieces were obtained when the test pieces were cut by use of a cutting tool rotating at 780 rpm. From the figure, it can be seen that the machined pieces are finely formed and then discharged, in which the machined pieces have an average roughness of 0.8 mm, and smoothness of the cutting face is very excellent.

Figure 4:
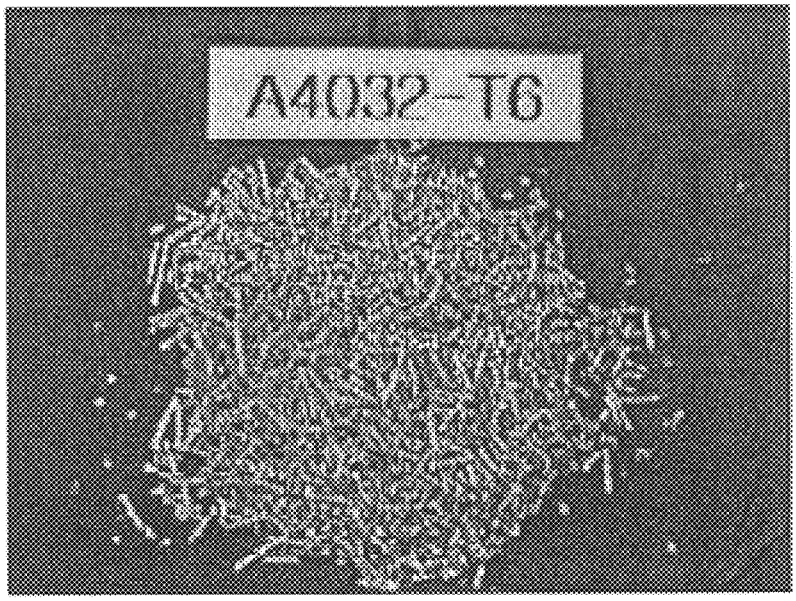
FIG. 4 is a photograph showing the state of machined pieces of A4032 alloy.

FIG. 4 shows the state of the machined pieces of A4032 alloy, in which test pieces are cut by use of a cutting tool, with rotation at 780 rpm, to yield the machined pieces.

The machined pieces were not finely formed and were present in a form of long state. They are an average of 1.3 $\mu$m in roughness.

From this test, it is apparent that smoothness of the cutting face of the conventional alloy is inferior to that of the inventive alloy.

In the present invention, alloys having various composition component ratios according to the example method were prepared, while adjusting the ratios within predetermined ranges. From this experiment, it was found that when Al—Si alloy consists essentially of, in weight percent, 3.0–5.0 Cu, 10.0–13.0 Si, 0.2–0.5 Fe, 2.5–5.0 Bi, 0.1–0.3 Sb, up to 0.1 Mg, up to 0.1 Ni and up of other elements, with the balance Al, such alloy has excellent elongation ratio and very similar mechanical properties to the Al—Si alloy of the example.

As described above, the eutectic Al—Si alloy of the present invention has the advantages of excellent machinability, easy cutting operation, extended lifetime of cutting tools and improved smoothness of cutting faces. In addition, the inventive alloy is excellent in elongation ratio and abrasion resistance and has good formability, while maintaining mechanical properties such as impact strength, tensile strength, yield strength and hardness applicable to pistons of compressors for air conditioners in automobiles, and thus can be applied to abrasion resistance-requiring applications, for example, pistons of compressors for air conditioners in automobiles, even though no surface treatment including anodizing or Sn plating is performed.

The present invention has been described in an illustrative manner, and it is to be understood that the terminology used is intended to be in the nature of description rather than of limitation. Many modifications and variations of the present invention are possible in light of the above teachings. Therefore, it is to be understood that within the scope of the appended claims, the invention may be practiced otherwise than as specifically described.

I claim:

1. A free-machinable eutectic Al—Si alloy, comprising 3.0–5.0 wt % Cu, 10.0–13.0 wt % Si, 0.2–0.5 wt % Fe, 2.5–5.0 wt % Bi, 0.1–0.3 wt % Sb, up to 0.1 wt % Mg, up to 0.1 wt % Ni and up to 0.5 wt % total sum of other elements, wherein a balance of said alloy comprises Al.

* * * * *